US007554509B2

(12) United States Patent
Hsu et al.

(10) Patent No.: US 7,554,509 B2
(45) Date of Patent: Jun. 30, 2009

(54) COLUMN ANTENNA APPARATUS AND METHOD FOR MANUFACTURING THE SAME

(75) Inventors: Kang-Neng Hsu, Hsinchu (TW); Chih-Ming Chen, Hsinchu (TW); Liang-Neng Lee, Hsinchu (TW); Kuo-Wei Wu, Hsinchu (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 317 days.

(21) Appl. No.: 11/509,655

(22) Filed: Aug. 25, 2006

(65) Prior Publication Data

US 2008/0048918 A1 Feb. 28, 2008

(51) Int. Cl.
*H01Q 1/36* (2006.01)

(52) U.S. Cl. ..... 343/895

(58) Field of Classification Search ..... 343/895, 343/850–853, 900

See application file for complete search history.

(56) References Cited

U.S. PATENT DOCUMENTS 5,134,422 A * 7/1992 Auriol ..... 343/895
5,191,352 A * 3/1993 Branson ..... 343/895
5,793,338 A * 8/1998 Standke et al. ..... 343/895
5,986,616 A * 11/1999 Edvardsson ..... 343/853
6,300,917 B1 * 10/2001 Leisten et al. ..... 343/895
6,424,316 B1 * 7/2002 Leisten ..... 343/895
7,345,650 B2 * 3/2008 Bae et al. ..... 343/895
2006/0017650 A1 * 1/2006 Allen et al. ..... 343/900
2006/0103586 A1 * 5/2006 Yang et al. ..... 343/895

* cited by examiner

*Primary Examiner*—Huedung Mancuso
(74) *Attorney, Agent, or Firm*—Rosenberg, Klein & Lee

(57) ABSTRACT

A column antenna apparatus and a manufacturing method thereof are disclosed. This invention forms a metal layer with at least two spiral structures on a column body. The column antenna apparatus can simplify the manufacturing process and enhance the yield rate. The column antenna apparatus includes a column body, a metal layer and at least two spiral structures. The metal layer is formed on the surface of the column body, and the at least two spiral structures are formed on the metal layer for increasing bandwidth of low frequency. Each spiral structure is formed by removing a part of the metal layer, and the column body is exposed via the at least two spiral structures.

18 Claims, 7 Drawing Sheets

COLUMN ANTENNA APPARATUS AND METHOD FOR MANUFACTURING THE SAME

BACKGROUND OF THE INVENTION

1. Field of the Invention

The present invention relates to a column antenna apparatus and a method for manufacturing the same, and particularly relates to a metal layer with at least two spiral structures that is formed on of a hollow column body.

2. Description of the Related Art

Due to the development of the communication technology, a lot of electronic products that adopt the wireless communication technology are developed, such as cell phones, wireless Internet devices and personal digital assistant (PDA) etc. The requirements for the wireless communication devices come from the consumers has become higher and higher, such as the effect, the appearance, and dimension. For cell phones, the receiving frequency has developed from single, two to three, four frequencies. The consumers also requests the cell phones has the characteristics, including fresh appearance, small dimension, light weight, and easy carry. Moreover, the receiving-signal effect of the wireless communication devices is an important index for evaluating the wireless communication devices and the antenna apparatus is a key factor to determine the receiving-signal effect of the wireless communication devices. Therefore, it is an important factor to develop an antenna apparatus that has an excellent receiving-signal effect and meets with the requirement of fresh appearance and small dimension.

Referring to FIGS. 1 and 2, firstly a spiral coil 10 is formed (as shown in the FIG. 2). Then, a fastening layer 12 is formed by a projecting method with a plastic material. Therefore, the spiral coil 10 is fastened to a screw base 14. Finally, a plastic layer 16 is wrapped to provide the functions, including protection and good appearance.

However, the spiral coil 10 has the deformation problem during the shipment. The deformation of the spiral coil will affect the receiving frequency and the quality of the antenna. Furthermore, in the projecting process, the spiral coil 10 also is deformed due to the force come from the plastic material. The receiving frequency and the quality of the antenna may be changed due to the deformation of the spiral coil. Therefore, the quality of the antenna cannot be controlled well during the manufacturing process. Moreover, due to the structure of the antenna, the dimension of the antenna cannot be further shrunk.

Moreover, the known antenna structure has some defects such as its bandwidth of low frequency is narrow.

SUMMARY OF THE INVENTION

One particular aspect of the present invention is to provide a column antenna apparatus and a method for manufacturing the same. This invention forms a spiral metal layer on a column body. The column antenna apparatus of the present invention can simplify the manufacturing process and enhance the yield rate.

Another particular aspect of the present invention is to provide a column antenna apparatus and a method for manufacturing the same. It forms a column body by using ceramic material. A metal layer is electroplated on the column body. Then, a spiral structure is formed on the metal layer. The structure of the column antenna apparatus of the present invention is simple. Therefore, the cost is reduced.

Further particular aspect of the present invention is to provide a column antenna apparatus and a method for manufacturing the same. This invention forms a spiral metal layer on a column body. By adjusting the pitch of the spiral structure, the spiral structure of the metal layer has a single pitch or a plurality of pitches. Therefore, the column antenna apparatus of the present invention can be applied to a wireless communication device having a single frequency, dual frequencies or multi frequencies, and the manufacturing method for producing multi pitches can be easily implemented.

Further particular aspect of the present invention is to provide a column antenna apparatus and a method for manufacturing the same. This invention forms a spiral metal layer on a column body. Its structure is simple. The dimension of the antenna can be shrunk according to the demand. Therefore, the column antenna apparatus of the present invention can be installed at outside of the wireless communication device to be an external type antenna. Alternatively, the column antenna apparatus can be installed at inside of the wireless communication device to be a built-in antenna. Thereby, the column antenna apparatus of the present invention can be installed at the wireless communication device with a variety of types to provide an excellent quality of receiving signal.

Further particular aspect of the present invention is to provide a column antenna apparatus and a method for manufacturing the same. The present invention has a metal layer with at least two spiral structures that is formed on of a hollow column body. Moreover, the two spiral structures are separatedly or superimposedly formed on the metal layer. Thereby, the present invention uses the hollow column body and the at least two spiral structures for increasing operation bandwidth of low frequency of the antenna apparatus.

In order to achieve above-mentioned aspects, the present invention provides a column antenna apparatus, comprising a column body, a metal layer, and at least two spiral structures. The metal layer is formed on a surface of the column body. The least two spiral structures are respectively formed on the metal layer. In addition, each spiral structure is formed by removing a part of the metal layer, and the column body is exposed via the at least two spiral structures.

In order to achieve above-mentioned aspects, the present invention provides a method for manufacturing a column antenna apparatus, comprising: providing a column body; forming a metal layer on a surface of the column body; and forming at least two spiral structures on the metal layer respectively.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1:
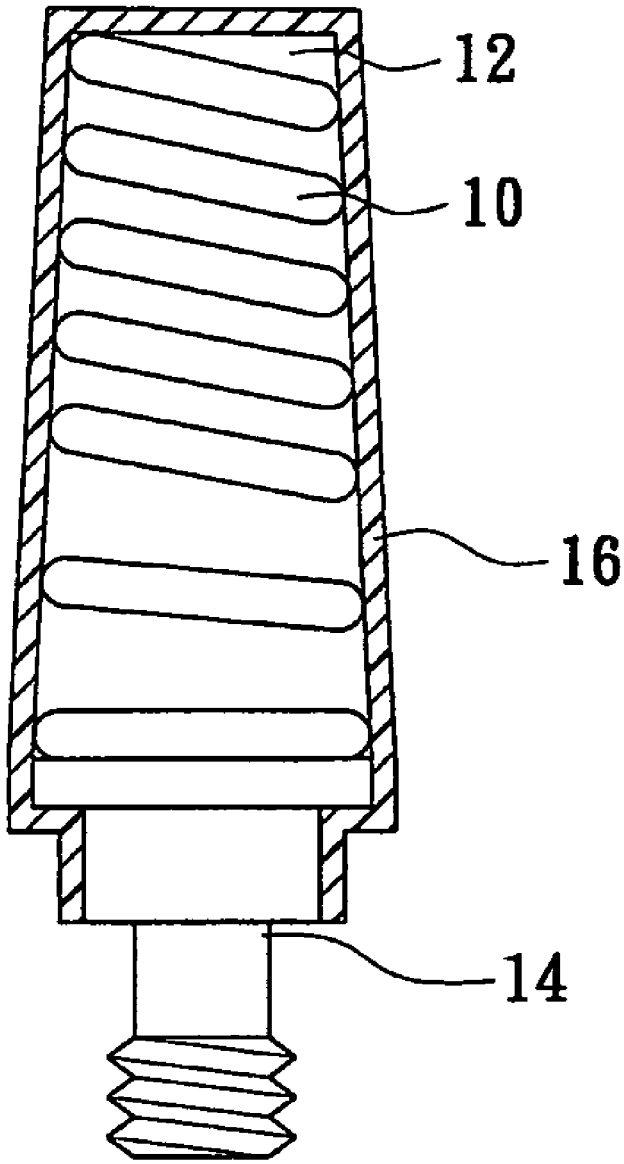
FIG. 1 PRIOR ART
FIG. 1 is a schematic view of a column antenna apparatus according to the prior art.
Figure 2:
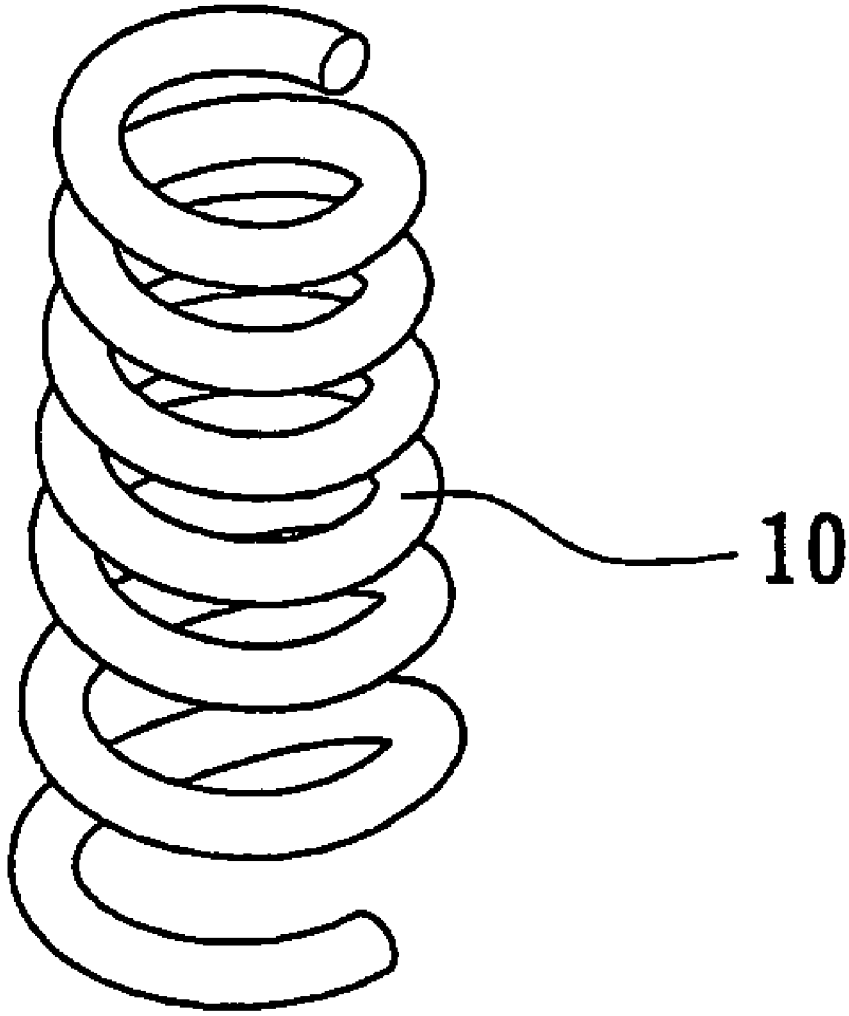
FIG. 2 PRIOR ART
FIG. 2 is a schematic view of a spiral coil of a column antenna apparatus according to the prior art.
Figure 3:
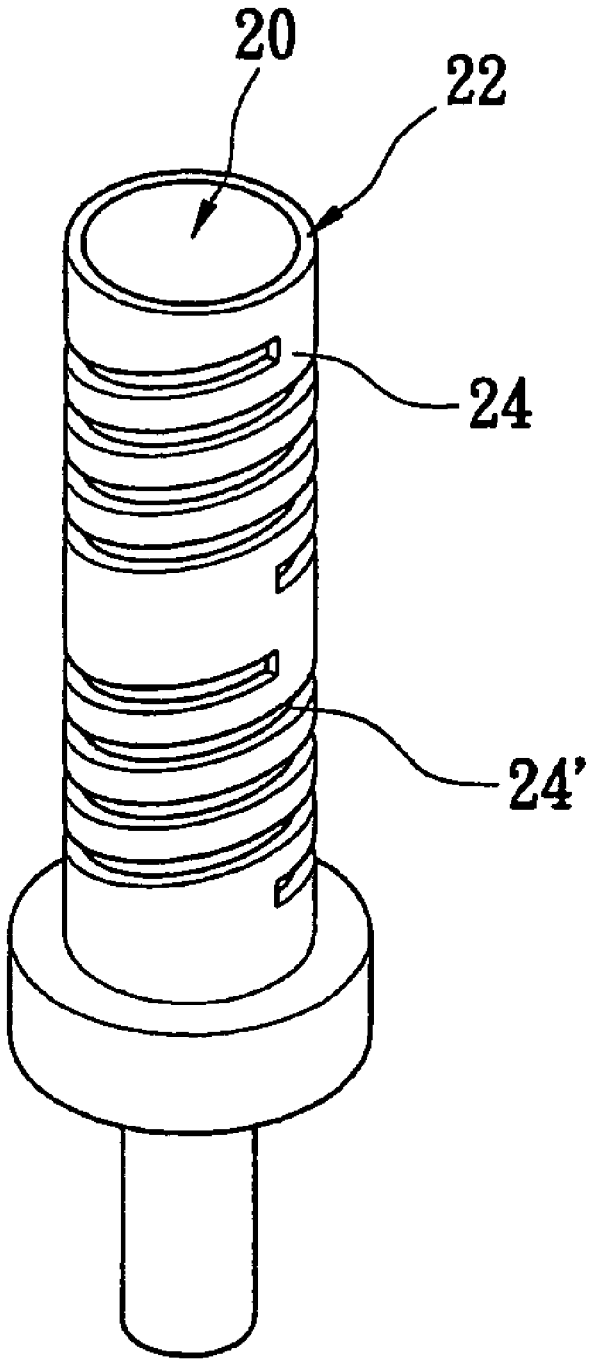
FIG. 3 is a perspective, schematic view of a column antenna apparatus according to the first embodiment of the present invention.

Referring to FIG. 3, the prevent invention of the first embodiment provides a column antenna apparatus that is composed of a column body 20, a metal layer 22, and at least two spiral structure 24, 24'.

Moreover, the column body 20 is made of ceramic or other materials that have the characteristics of insulation and being electroplated. The metal layer 22 is formed on a surface of the column body 20 and wraps all of the column body 20. In addition, the metal layer 22 is made of copper, gold, or other materials that have the characteristic of good electric conductivity.

Furthermore, the at least two spiral structures 24, 24' are respectively formed on the metal layer 22, and the two spiral structures 24, 24' are separatedly formed on the metal layer 22. In addition, each spiral structure 24 or 24' is formed by removing a part of the metal layer 22, and the column body 20 is exposed via the at least two spiral structures 24, 24'.

By adjusting the pitch of the two spiral structures 24, 24' of the column antenna apparatus of the present invention, the column antenna apparatus of the present invention can be applied to a wireless communication device having a single frequency, dual frequencies, three frequencies or multi frequencies. When the pitch of the two spiral structures 24, 24' of the column antenna apparatus is identical, the column antenna apparatus is a single frequency antenna. When the two spiral structures 24, 24' of the column antenna apparatus have two different pitches, the column antenna apparatus is a dual frequency antenna. When the two spiral structures 24, 24' of the column antenna apparatus have more than two different pitches, the column antenna apparatus is a multi frequency antenna. The column antenna apparatus can be used in a wireless communication that receives multi frequency signals, such as a three frequencies cell phone supporting 900, 1800 and 1900 MHz. Hence, the two spiral structures 24, 24' can be design to has the same or different pitches according to actual need for users.

Furthermore, the column antenna apparatus of the present invention can be applied to an external antenna. Due to the structure of the column antenna apparatus is simple, the dimension of the column antenna apparatus can be shrunk according to the demand. Therefore, the column antenna apparatus of the present invention can be installed on the circuit board located in the wireless communication device to form a built-in antenna, namely a hidden antenna.

Figure 4:
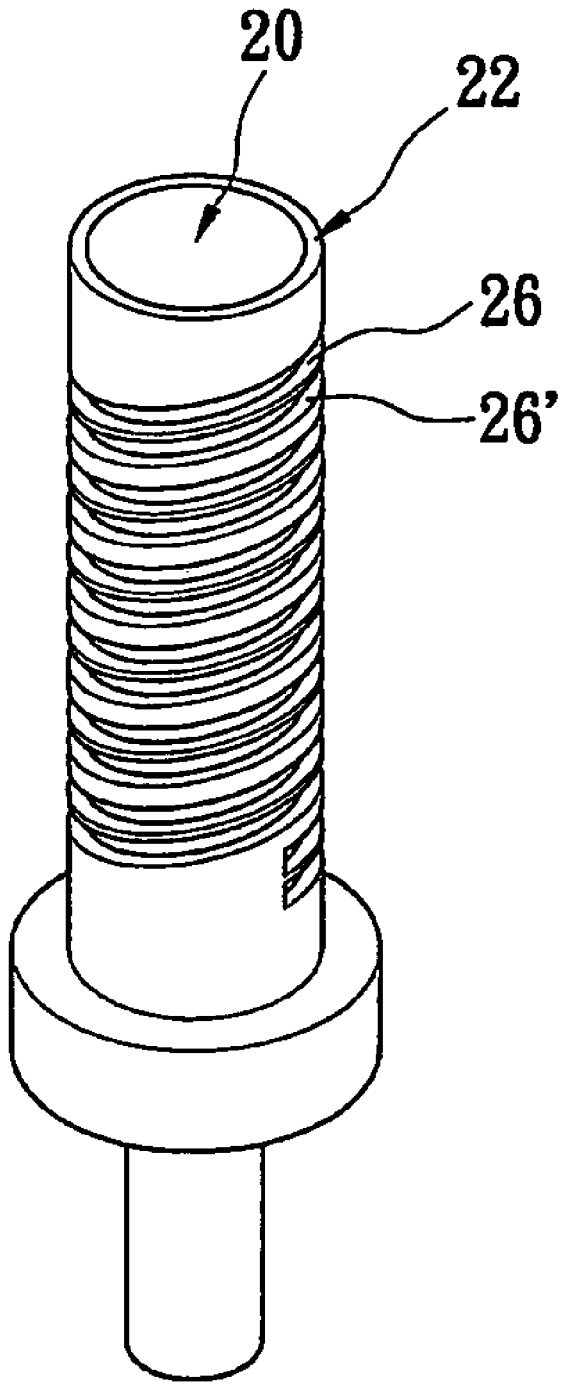
FIG. 4 is a perspective, schematic view of a column antenna apparatus according to the second embodiment of the present invention.

Referring to FIG. 4, the difference between the second embodiment and the first embodiment is that the two spiral structures 26, 26' are superimposedly formed on the metal layer 22.

Figure 5:
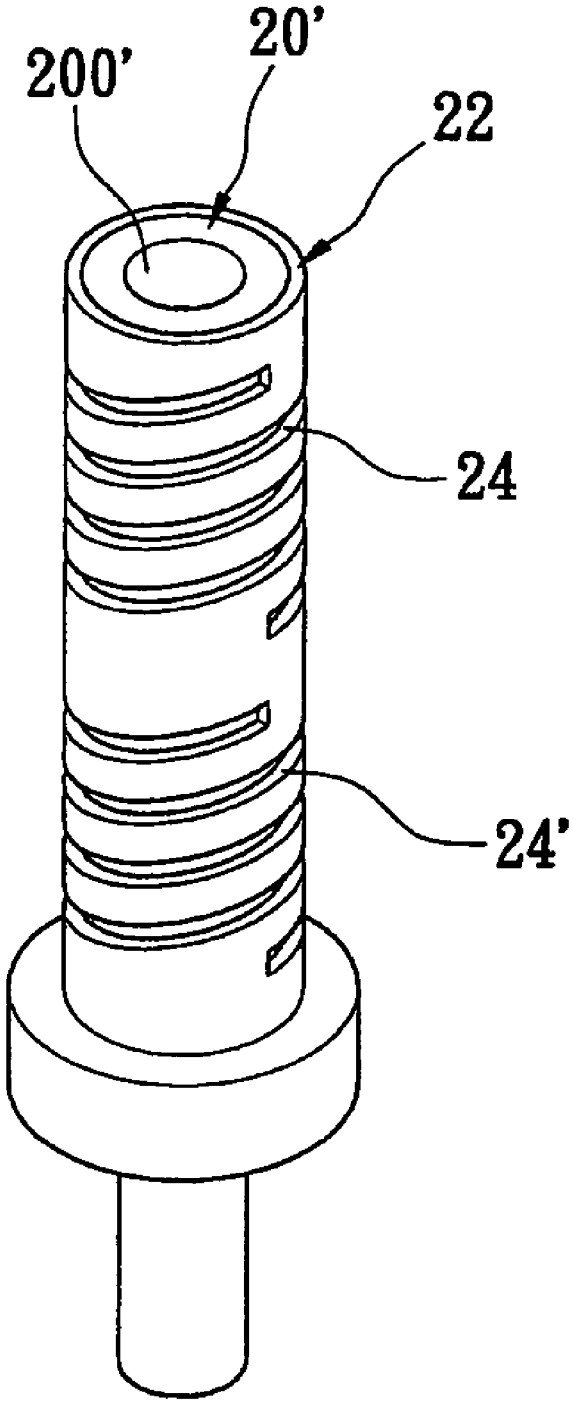
FIG. 5 is a perspective, schematic view of a column antenna apparatus according to the third embodiment of the present invention.
Figure 6:
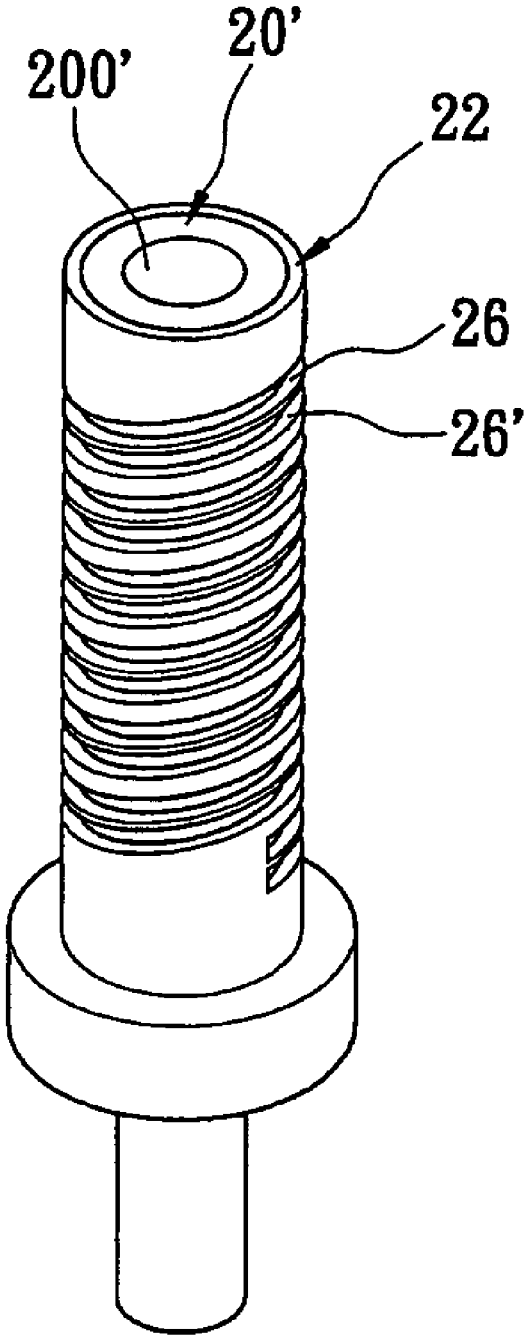
FIG. 6 is a perspective, schematic view of a column antenna apparatus according to the fourth embodiment of the present invention.

Referring to FIGS. 5-6, the third and the fourth embodiments provides a column body 20' that is a hollow column body with a through hole 200' for increasing operation bandwidth of low frequency of the antenna apparatus.

Figure 7:
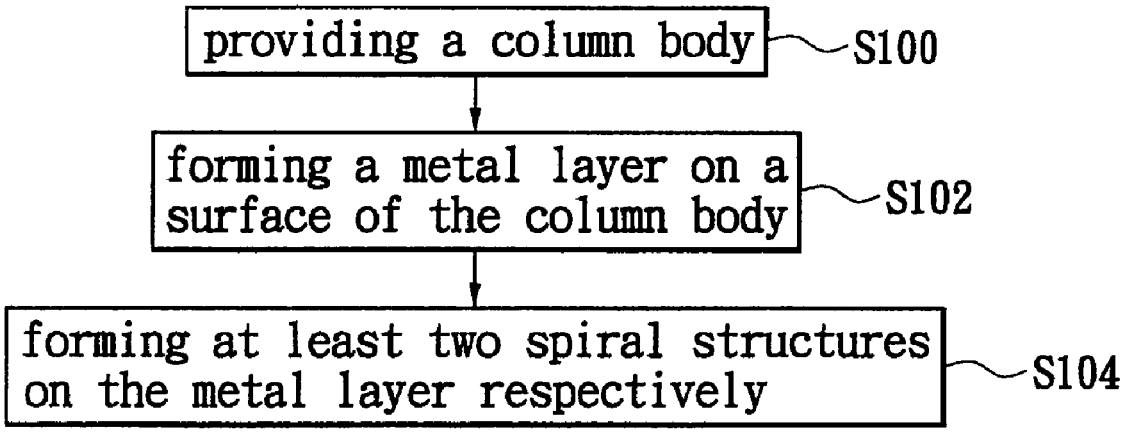
FIG. 7 is a flow chart of a method for manufacturing a column antenna apparatus of the present invention.

Referring to FIG. 7, the prevent invention provides a method for manufacturing a column antenna apparatus, comprising: providing a column body 20 or 20' (S100); forming a metal layer 22 on a surface of the column body 20 or 20' (S102); and forming at least two spiral structures 24, 24' or 26, 26' on the metal layer 22 respectively (S104).

In other words, the manufacturing method includes forming a column body 20 or 20' by using ceramic. Then, a metal layer 22 is formed on the surface of the column body 20 or 20' by electroplating, such as a copper layer or a gold layer. Further, at least two spiral structures 24, 24' or 26, 26' are formed on the metal layer 22 by a lathing. The two spiral structures 24, 24' or 26, 26' are formed by removing a part of the metal layer 22, and the column body 20 or 20' is exposed via the at least two spiral structures 24, 24' or 26, 26'.

Furthermore, by adjusting the program of the lathe, the two spiral structures 24, 24' or 26, 26' can have a single pitch or multi pitches to form a single, dual or multi frequencies antenna.

The column antenna apparatus and a manufacturing method thereof of the present invention has the following characteristics:

1. The column antenna apparatus of the present invention forms a spiral metal layer on a column body to simplify the manufacturing process and increase the yield rate.

2. The structure of the column antenna apparatus of the present invention is simple. Therefore, the cost is reduced.

3. By adjusting the pitch of the spiral structure, the column antenna apparatus of the present invention can be applied to a single, dual, three or multi frequencies wireless communication device.

4. The structure of the column antenna apparatus of the present invention is simple and can be shrunk according to the demand. Therefore, the column antenna apparatus of the present invention can be used for an external antenna or a built-in antenna.

5. The two spiral structures are separatedly or superimposedly formed on the metal layer. Thereby, the present invention uses the hollow column body and the at least two spiral structures for increasing operation bandwidth of low frequency of the antenna apparatus.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A column antenna apparatus, comprising:

a column body having a solid shape and a whole top surface of the column body being exposed;

a metal layer formed on a periphery surface of the column body only; and at least two hollow spiral structures formed on the metal layer, and the at least two hollow spiral structures being separated from each other;

wherein each hollow spiral structure is formed by removing one part of the metal layer, and one part of the periphery surface of the column body is exposed via the at least two hollow spiral structures.

2. The column antenna apparatus as claimed in claim 1, wherein the column body is made of ceramic.

3. The column antenna apparatus as claimed in claim 1, wherein the metal layer is made of copper or gold.

4. The column antenna apparatus as claimed in claim 1, wherein each hollow spiral structure has a single pitch.

5. The column antenna apparatus as claimed in claim 1, wherein each hollow spiral structure has a plurality of different pitches.

6. The column antenna apparatus as claimed in claim 1, wherein the two hollow spiral structures have same pitch.

7. The column antenna apparatus as claimed in claim 1, wherein the two hollow spiral structures have different pitch.

8. The column antenna apparatus as claimed in claim 1, wherein the two hollow spiral structures are superimposedly formed on the metal layer.

9. A method for manufacturing a column antenna apparatus, comprising:

providing a column body that has a solid shape, wherein a whole top surface of the column body is exposed;

forming a metal layer on a periphery surface of the column body only; and forming at least two hollow spiral structures on the metal layer by removing one part of the metal layer, wherein the at least two hollow spiral structures are separated from each other.

10. The method as claimed in claim 9, wherein the column body is exposed via the at least two hollow spiral structures.

11. The method as claimed in claim 9, wherein the column body is made of ceramic.

12. The method as claimed in claim 9, wherein the metal layer is made of copper or gold.

13. The method as claimed in claim 9, wherein the step of forming the metal layer on the surface of the column body is implemented by electroplating.

14. The method as claimed in claim 9, wherein each hollow spiral structure has a single pitch.

15. The method as claimed in claim 9, wherein each hollow spiral structure has a plurality of different pitches.

16. The method as claimed in claim 9, wherein the two hollow spiral structures have same pitch.

17. The method as claimed in claim 9, wherein the two hollow spiral structures have different pitch.

18. The method as claimed in claim 9, wherein the two hollow spiral structures are superimposedly formed on the metal layer.

* * * * *